United States Patent [19]

Jackson et al.

[11] 4,434,841

[45] Mar. 6, 1984

[54] VARIABLY SPACED WRAPPED FIN HEAT EXCHANGER

[75] Inventors: Dale Jackson, Clay; John R. McManus, Marcellus, both of N.Y.

[73] Assignee: Carrier Corporation, Syracuse, N.Y.

[21] Appl. No.: 320,378

[22] Filed: Nov. 12, 1981

[51] Int. Cl.[3] ..... F24B 1/06

[52] U.S. Cl. ..... 165/125; 165/172; 165/147; 62/508

[58] Field of Search ..... 165/125, 172, 140, 147, 165/DIG. 5; 62/507, 508

[56] References Cited

U.S. PATENT DOCUMENTS

| | | | |
|---|---|---|---|
| 1,791,528 | 2/1931 | Hull | 165/147 |
| 1,915,352 | 6/1933 | Bottoms | 165/172 |
| 1,965,553 | 7/1934 | Lear | 165/140 |
| 3,592,029 | 7/1971 | Spellen . | |
| 3,772,905 | 11/1973 | Peddinghaus . | |
| 3,821,525 | 6/1974 | Eaton et al. . | |
| 4,080,181 | 3/1978 | Feistel et al. . | |

*Primary Examiner*—William R. Cline
*Assistant Examiner*—John F. McNally
*Attorney, Agent, or Firm*—Donald F. Daley; Robert P. Hayter

[57] ABSTRACT

A wrapped fin heat exchanger is disclosed having variable spacing between adjacent loops forming the heat exchanger. Various embodiments are shown wherein the spacing between adjacent loops of single row and multi-row coils is varied to provide for equal heat transfer per loop of the heat exchanger and to effectively level out the air flow per loop. The various embodiments include varied spacing over a single row coil and multiple row coils having partial second rows and second rows with varied spacing while the first row has fixed spacing.

11 Claims, 4 Drawing Figures

VARIABLY SPACED WRAPPED FIN HEAT EXCHANGER

BACKGROUND OF THE INVENTION

1. Field of the Invention

This invention relates to heat exchangers for transferring heat energy between two separate fluids. More particularly, the present invention relates to a wrapped fin heat exchanger having a fin material wrapped about a tube to form an enhanced heat transfer surface. Specifically, the present invention concerns the spacing of the loops of wrapped fin tubing forming a heat exchanger to promote equal heat transfer between fluid flowing through the tubing and heat transfer fluid flowing over the tubing notwithstanding the flow irregularities due to the location of a fan for drawing heat transfer medium over the heat exchanger.

2. Description of the Prior Art

It is known to manufacture a heat transfer surface formed by having a base tubular member fabricated from aluminum or another heat transfer material and having a fin material helically would about the base member. This fin material may be formed in a U-shapes and wrapped about the tube with the base of the fin contacting the exterior surface of the base tube to form a metal to metal contact promoting heat transfer from the tube to the fin. By this extended fin surface, it is possible to provide increased heat transfer between fluid flowing through the tube and a gaseous substance flowing over the tube. The fin surface of the type described is disclosed in U.S. Pat. No. 3,134,166 issued to Venables.

This wrapped fin tubing is specifically formed into a geometrical configuration in conjunction with a heat exchange unit and a fan for circulating air thereover. A heat exchanger of this material has many applications including that of a refrigeration circuit for an air conditioning system wherein refrigerant flows through the tube and air flows over the exterior enhanced portion of the heat exchanger. In this application, heat energy is transferred between air flowing over the exterior and in contact with the wrapped fins of the heat exchanger and a refrigerant flowing through the interior of the tube. A heat exchanger may be formed in many configurations to provide the appropriate air flow relationship thereover. A fan is typically mounted as part of the air conditioning unit for drawing air through or pushing air over the heat transfer surface.

One of the many heat exchanger configurations possible for use in a heat exchange unit is forming the heat exchanger in a cylindrical shape. A long continuous tube may be wrapped into a generally cylindrical configuration to serve as the heat exchanger. This heat exchanger is often mounted in a heat exchange unit including a base pan for supporting the cylindrical heat exchanger and a top cover. A louvered exterior casing for allowing air to flow into and across the heat exchange surfaces is additionally provided. Conventionally, a fan is mounted at the top of the heat exchanger to draw air in through the cylindrical sides of the heat exchanger and to exhaust that air upwardly away from the air conditioning unit. It has been found that when a fan is mounted adjacent one end of a cylindrical heat exchanger for drawing air from the heat exchanger that the air flow through the heat exchanger is uneven. Typically, larger air volume per unit length of heat exchanger are drawn inwardly through the top portions of the heat exchanger adjacent the fan than from the bottom portions of the heat exchanger furthest from the fan. Uneven air flow results in a lessened heat exchanger performance since a reduced air flow passes through a portion of the heat exchanger.

In order to provide for increased heat transfer efficiency for the entire heat exchanger several modifications to the cylindrical configuration of the heat exchanger have been found and are believed to be effective. One manner of providing a more even air flow across the length of the heat exchanger is to space the individual loops of tubing forming the heat exchanger differently. If the loops are spaced more closely together in the higher flow regions the air flow resistance is increased and more air is drawn in through the lower flow regions at the other end of the heat exchanger to balance heat transfer. Additionally, if the tube spacing is closer at the higher flow areas then the given volume flow per loop may be equalized, although the volume flow per unit length is not equalized. It is the volume of air flow per loop which needs to be equalized to promote even heat transfer across the length of the heat exchanger.

Several alternative constructions are disclosed herein for accomplishing the spacing differential to provide for even heat transfer per loop in the heat exchanger. One of these embodiments incorporates a single row heat exchanger having various loops spaced differently along the length thereof. Other embodiments include multiple row heat exchangers wherein a single row is spaced evenly and the second row is spaced according to the air flow patterns or a heat exchanger having multiple rows where the second row extends only over the higher volume flow portion of the heat exchange surface.

SUMMARY OF THE INVENTION

It is an object of the present invention to provide an efficient heat exchanger formed from wrapped fin tubing.

Another object of the present invention is to provide a structural configuration for a wrapped fin heat exchanger which provides for efficient heat transfer.

Another object of the present invention is to provide appropriate spacing between the individual loops of a wrapped fin heat exchanger to promote even air distribution per loop throughout the heat exchanger.

Another object of the present invention is to provide a safe, economical and easy to assemble wrapped fin heat exchanger incorporating varied spacing between adjacent loops to promote efficient heat exchange and balanced heat transfer medium flow therethrough.

Further objects of the present invention will be apparent from the description to follow and from the appended claims.

These and other objects of the invention are achieved in accordance with a preferred embodiment by the use of a wrapped fin heat exchanger made from a single length of wrapped fin tubing having a tubular fluid conducting portion and fin material wrapped about the tubular portion to promote heat transfer between fluid flowing through the tubular portion and gas flowing thereover. The heat exchanger is generally cylindrical in configuration and is adapted to have the gas drawn inwardly through the heat exchanger by a fan mounted adjacent one end of the heat exchanger, said fan acting to draw varying volumes of air through the heat exchanger at different locations depending upon the distance between the location and the fan. A plurality of loops of tubing are arranged to form the cylindrical heat exchanger, a first portion of said loops being spaced closely to impede the flow of gas therethrough and the second portion of said loops being spaced less closely than the first portion, said portions being located with the first portion being in a higher gas flow location of the heat exchanger and the second portion being in a lower gas flow location of the heat exchanger.

Several specific embodiments incorporating varied spacing between loops are disclosed. These include a single row heat exchanger having the spacing between adjacent loops varied to promote even air flow. Likewise, multiple row heat exchangers are disclosed having variable spacing in only a single row or a partial second row in the higher volume air flow areas only.

DESCRIPTION OF THE DRAWINGS

FIG. 3A is an enlarged view of a circled portion of Figure 3.

FIG. 3B is an enlarged portion of a circled portion of FIG. 3.

FIG. 4A is an enlarged view of a circled portion of FIG. 4.

FIG. 4B is an enlarged view of a separate circled portion of FIG. 4.

DESCRIPTION OF THE PREFERRED EMBODIMENT

The preferred embodiment of the present invention is shown herein having loops of a wrapped fin heat exchanger spaced in varying relationships. Several specific embodiments of the present invention are disclosed. It is to be understood by those skilled in the art that other embodiments incorporating various spacing between loops to accomplish the enhanced heat transfer and balanced air flow of the described invention are within the spirit and scope of the present invention. It is also to be understood that although the configuration of the heat exchanger is herein referred to as cylindrical that, as used herein, cylindrical includes heat exchangers having square, L-shaped or other configurations which have the same operating characteristics.

Figure 1:
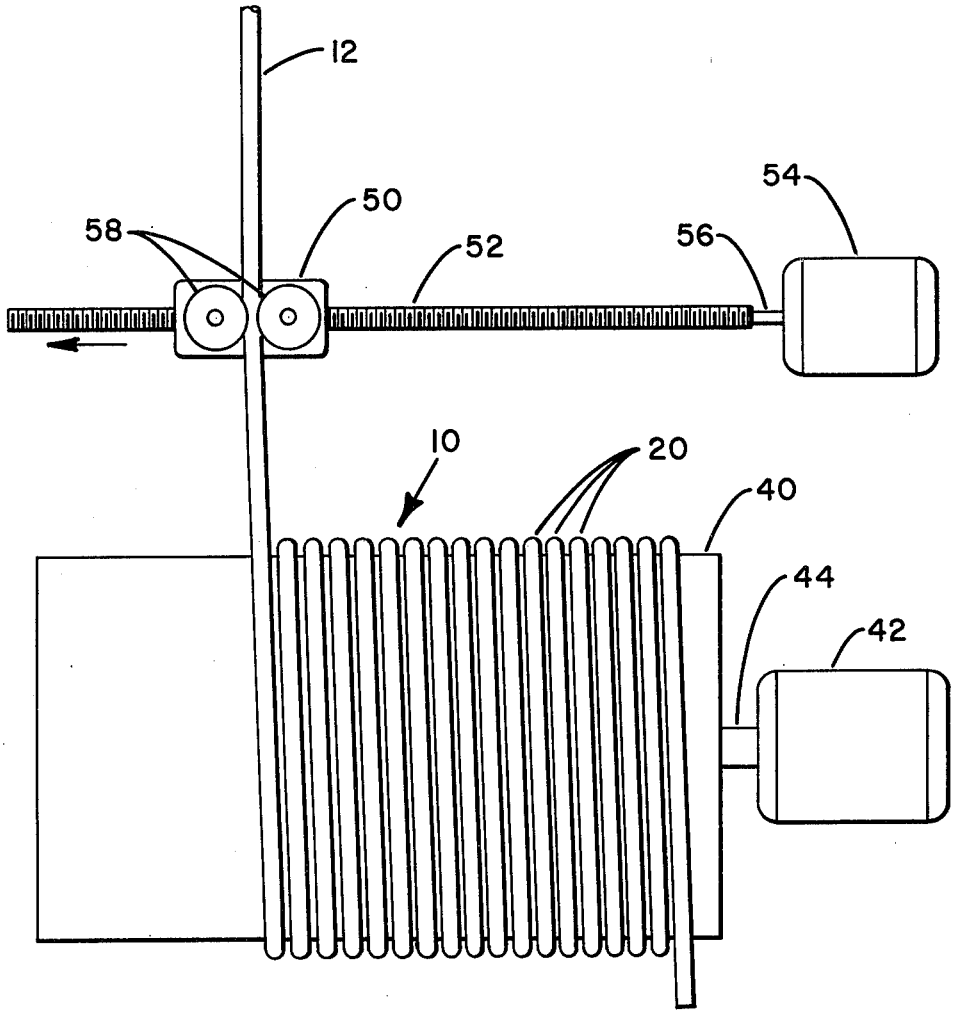
FIG. 1 is a schematic view of a wrapped fin heat exchanger being wound about a drum.

Referring to FIG. 1, there may be seen a schematic representation of a cylindrical heat exchanger being wound on a drum. Specifically, tubing 12 is shown being guided via guide wheels 58 mounted on the head 50 such that the tubing is spaced appropriately along drum 40 to form heat exchanger 10. Motor 42 connected by shaft 44 to drum 40 rotates the drum such that heat exchanger 10 is formed by tubing 12 being helically wound about the drum in individual loops 20.

The spacing of loops 20, as they are wound about the tube, is controlled by head 50. Motor 54 connected by shaft 56 to threaded rod 52 acts to control the location of head 50. As motor 54 rotates the shaft the head is moved longitudinally parallel to the length of the drum to guide the tubing as it is wrapped about the drum. Upon an increase in the rotational velocity of motor 54 the spacing between adjacent loops 20 on drum 40 is increased. Hence, to obtain the spacing as shown in FIG. 1, the speed of motor 54 is gradually increased as the heat exchanger is wound about the drum. To provide a second row of tubing about the drum, the tubing is simply overwound upon the shown row of loops.

Figure 2:
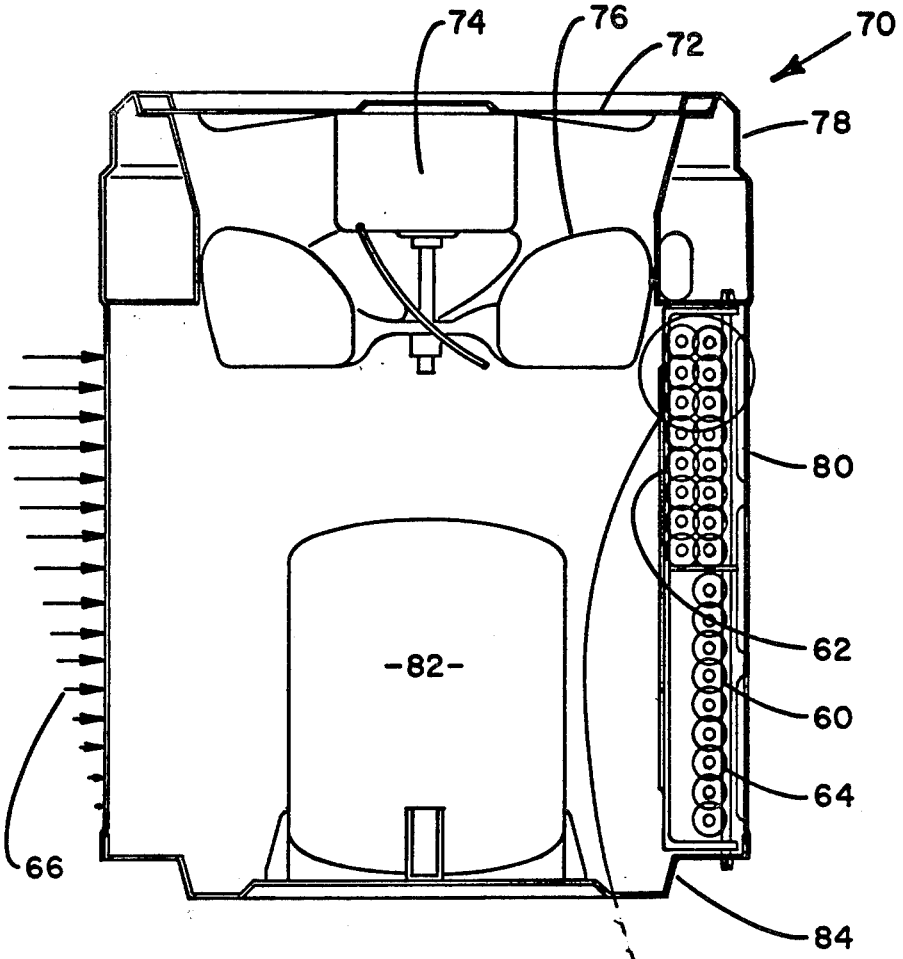
FIG. 2 is a schematic sectional view of a heat exchange unit incorporating a wrapped fin heat exchanger; said Figure including a cut away portion wherein an air velocity profile is shown.

In FIG. 2 there can be seen a heat exchange unit such as may be found in a condensing or outdoor unit of an air conditioning system. Typically, a base pan 84 secures the base of the unit having compressor 82 mounted thereto. Top cover 78 including top discharge grille 72 is shown mounted at the top of the unit. Fan motor 74 is suppoted by discharge grille 72 and has fan 76 mounted thereto. Fan 76 is a propeller type fan arranged to draw air into the unit through heat exchanger 60 and to discharge that air from the unit through top discharge grille 70. Louvered casing 80 is mounted about the exterior of the unit and defines louver openings for allowing air to enter the unit. Heat exchanger 60 is mounted about the circumference of the unit in juxtaposition to louvered casing 80.

Figure 2A:
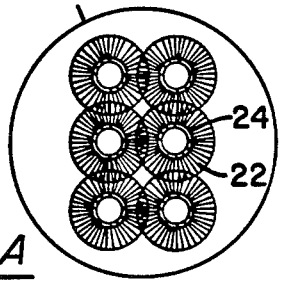
FIG. 2A is an enlarged view of the circled portion of FIG. 2.

Heat exchanger 60, as shown in FIG. 2, has an outer row 64 and inner row 62. The outer row extends the length of the heat exchanger and the inner row extends only over a portion of the heat exchanger. FIG. 2A is an enlarged view of a portion of heat exchange 60 and shows the intermeshing of fins 22 mounted about tubes 24 of the various loops of the heat exchanger. As may be seen in FIG. 2A, there is intermeshing between the adjacent loops of the enlarged portion. The portion of outer row 64 extending below where inner row 62 stops may also have some intermeshing between adjacent loops, however, inner row 62 is not provided in this area and consequently the double intermeshing between two rows as well as the intermeshing between the adjacent rows of the inner loop is not provided.

Opposite the view of heat exchanger 60 in FIG. 2 is a velocity profile 66. As may be seen, this velocity profile indicates the relative velocity of the air flow entering the heat exchange unit. This velocity profile is based upon the fan location and even spaced loops of tubing. As may be seen therein, the velocity of the air entering through the heat exchanger is increased at the end of the cylinder adjacent the fan and gradually decreases towards the end of the cylinder distant from the fan. Hence, much more air enters the heat exchanger at the end of the heat exchanger adjacent the fan and the loops at the end of the heat exchanger distant from the fan are much less effective in transferring heat energy since much less air flows thereover.

Figure 3:
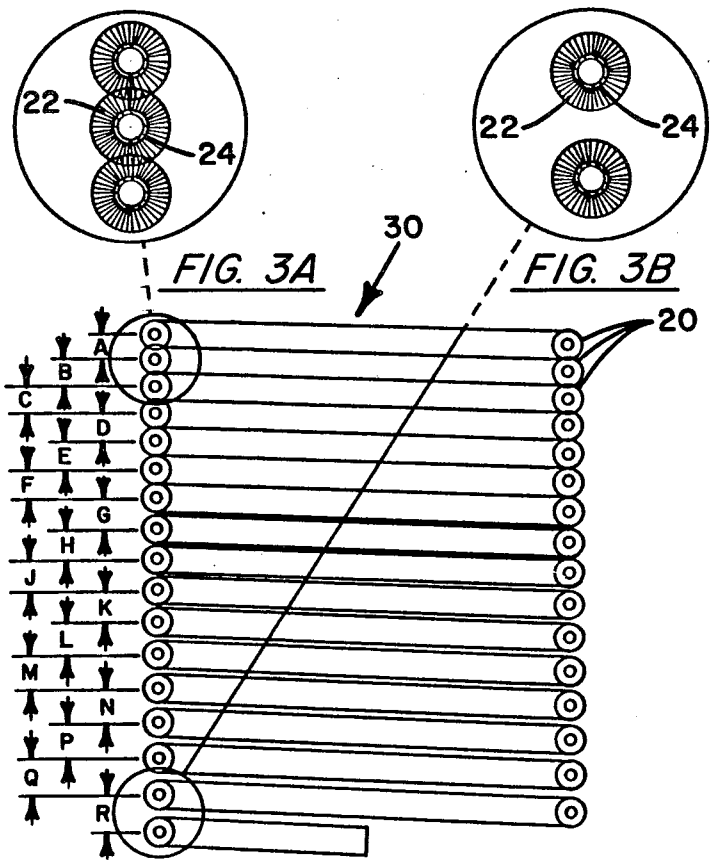
FIG. 3 is a sectional view of a single row wrapped fin heat exchanger.

Referring now to FIG. 3 there can be seen a single row heat exchanger having variable spacing between adjacent rows. At the top of heat exchanger 30 loops 20 are spaced much more closely than they are at the bottom of the heat exchanger. As may be seen at the side of the heat exchanger the distance between the center lines adjacent loops is indicated. The spacing at the top, as shown by distances A, B, C is much less than the spacing at the bottom as shown by distances J, K, L. FIGS. 3A and 3B are enlargements of portions of the heat exchange surface and show that at the top of the heat exchanger, as shown in FIG. 3A, the fins from the adjacent loops intermesh significantly. At the bottom of the heat exchanger, as shown in FIG. 3B, the fins do not engage each other at all. Somewhere between the locations shown in FIGS. 3A and 3B there may be a portion where the ends of the fins in each loop just contact each other or barely intermesh or barely are spaced from each other. Hence, it can be seen that as the distance varies along the length of the heat exchange unit the spacing between the adjacent loops continues to increase.

Figure 4:
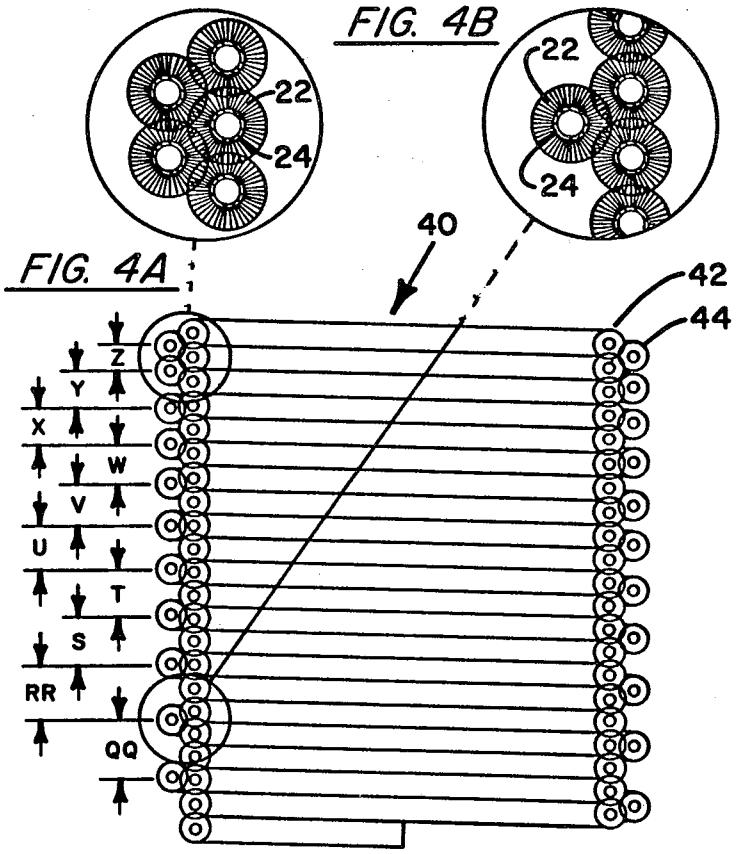
FIG. 4 is a sectional view of a multi-row heat exchanger.

Referring now to FIG. 4 there can be seen another embodiment having loops spaced in different relationships. In the embodiment shown in FIG. 4, the inner row 42 of heat exchanger 40 is shown having constant spacing across the entire length of the heat exchange unit. Outer row 44 is shown being spaced over the length of the unit, however, outer row 44 has spacing which varies significantly depending upon the location along the length of the heat exchanger. As may be seen by the spacing indicated to the side of outer row 44, the Z and Y spacing is much narrower than the V and W spacing. FIG. 4A shows the intermeshing of the inner and outer rows at the circled location. FIG. 4B shows the relative spacing between the inner and outer rows at the 4B location. Again, the change in spacing is apparent as the distance from the fan location increases.

The invention has been described with reference to specific embodiments. It is to be understood by those skilled in the art that variations and modifications can be effected thereto within the scope and spirit of the invention.

What is claimed is:

1. A wrapped fin heat exchanger made from wrapped fin tubing including a tubular fluid conducting portion and a fin portion wrapped about the tubular portion to promote heat transfer to a gas flowing thereover, said heat exchanger having the gas forced through the heat exchanger by a fan mounted adjacent one end of the heat exchanger, said fan acting to draw varying volumes of air through the heat exchanger at different locations depending upon the distance between the location and the fan, which comprises a plurality of loops of tubing arranged to form the heat exchanger, a first portion of said loops being spaced closely to impede the flow of the gas therethrough and a second portion of said loops being spced less closely than the first portion, said portions being located with the first portion being in a higher gas volume location and the second portion being in a lower gas volume location.

2. The apparatus as set forth in claim 1 wherein the loops of the first portion are spaced with the fins from each loop intermeshing with the fins from the adjacent loop and wherein the loops of the second portion are spaced with the fins of adjacent loops not intermeshing.

3. The apparatus as set forth in claim 1 wherein the loops of the first portion are located at the end of the heat exchanger adjacent the fan and the loops of the second portion are located at the opposite end of the heat exchanger from the fan and wherein the loops between the first portion and the second portion are spaced at varying increments to achieve the appropriate flow of gas therethrough.

4. The apparatus as set forth in claim 1 wherein the loops are arranged in multiple rows and wherein the first portion includes loops from at least two rows.

5. The apparatus as set forth in claim 4 wherein one row of loops extends the length of the heat exchanger having equal spacing between adjacent loops and wherein a second row of loops extends only a portion of the length of the heat exchanger.

6. The apparatus as set forth in claim 4 wherein one row of loops extends the length of the heat exchanger having equal spacing between loops and a second row of loops extends the length of the heat exchanger having unequal spacing between loops.

7. A wrapped fin heat exchanger formed into a generally cylindrical configuration, the heat exchanger having been formed from wrapped fin tubing including a tubular fluid conducting portion and a fin portion wrapped about the tubular portion, said heat exchanger being adapted to transfer heat energy between a fluid flowing through the tube and a gas flowing thereover in equal amounts per volume of gas flowing through different parts of the heat exchanger notwithstanding differing volumes of flow at different locations of the heat exchanger which comprises:

a plurality of loops of tubing being positioned to form the generally cylindrical configuration;

a first portion of said loops being closely spaced to adjacent loops, said first portion of loops being located at a portion of the heat exchanger having a higher gas volume flow rate; and a second portion of said loops being less closely spaced to adjacent loops and being located at a portion of the heat exchanger having a lesser volume flow rate.

8. The apparatus as set forth in claim 7 wherein the loops of the first portion are arranged such that the fins of adjacent loops intermesh and wherein the loops of the second portion are arranged such that the fins of adjacent loops do not intermesh.

9. The apparatus as set forth in claim 7 wherein the heat exchanger is formed with multiple rows of loops and wherein the fins from the loops of the multiple rows in the first portion all intermesh with each other.

10. The apparatus as set forth in claim 9 wherein the heat exchanger has a first row of loops spaced evenly over the length of the heat exchanger and a second row of loops spaced over only a portion of the heat exchanger.

11. The apparatus as set forth in claim 9 wherein the heat exchanger has multiple rows extending the length of the heat exchanger, the spacing between adjacent loops varying in at least one of said rows.

* * * * *